United States Patent [19]

Ban

[11] 3,938,987

[45] Feb. 17, 1976

[54] PROCESS FOR PREPARING A SMELTER FURNACE CHARGE COMPOSITION

[75] Inventor: Thomas E. Ban, South Euclid, Ohio

[73] Assignee: McDowell-Wellman Engineering Company, Cleveland, Ohio

[22] Filed: Apr. 11, 1974

[21] Appl. No.: 460,125

Related U.S. Application Data

[63] Continuation-in-part of Ser. No. 353,594, April 23, 1973, abandoned.

[52] U.S. Cl. ..... 75/3; 75/4; 75/11

[51] Int. Cl.[2] ..... C22B 1/16; C21C 5/52

[58] Field of Search ..... 75/3–5, 11

[56] References Cited

UNITED STATES PATENTS

| | | | |
|---|---|---|---|
| 2,805,141 | 9/1957 | Apuli | 75/3 |
| 2,805,929 | 9/1957 | Udy | 75/11 |
| 2,806,779 | 9/1957 | Case | 75/4 |
| 3,276,859 | 10/1966 | Collin | 75/3 |
| 3,495,971 | 2/1970 | Ban | 75/3 |

*Primary Examiner*—Peter D. Rosenberg
*Attorney, Agent, or Firm*—McNenny, Farrington, Pearne & Gordon

[57] ABSTRACT

There is provided an improved process for preparing a charge composition for a smelting furnace in accordance with which a deficiency of nonagglomerating carbonaceous material is utilized within pellets formed from iron oxide ore with or without an added flux material, and these pellets sintered on a traveling grate machine in the presence of externally supplied carbonaceous material in the sinter bed sufficient to make up the deficiency within the pellets.

5 Claims, 3 Drawing Figures

PROCESS FOR PREPARING A SMELTER FURNACE CHARGE COMPOSITION

RELATED APPLICATION

This application is a continuation-in-part of my copending application Ser. No. 353,594 filed Apr. 23, 1973, now abandoned.

BACKGROUND OF THE INVENTION AND PRIOR ART

Composite pellets of carbon and prereduced iron oxides have been recognized as a highly beneficiated charge for an electric smelting furnace or a blast furnace for the production of metallic iron. Such composite pellets comprised of iron in the metallic state, iron oxides, gangue constituents, and carbon can be produced by a number of processes, of which some have been described as both metallized and carbonized pellet products and exemplified by such patents as U.S. Pat. Nos. 2,805,141 to Apuli, 2,806,779 to Case, 3,218,153 to Schei et al, 3,219,436 to Heitmann et al, 3,333,951 to Ban, 3,264,091 to Ban, 3,264,092 to Ban, 3,276,859 to Collin et al, 3,304,168 to Ban, 3,751,241 to Sloughfy et al, and 3,759,693 to Kunii et al.

The present invention is an improvement on all of the foregoing although the most important of the references known at this time is the U.S. Pat. to Case No. 2,806,779. This patent contemplates the preparation of hardened iron ore pellets by forming within the pellet a "char bond" of graphite material. Ranges of concentration of the char bonding carbonaceous material utilized in specific examples recited by Case overlap the ranges of concentration of nonagglomerating carbonaceous material utilized in accordance with the present invention. Although mention is made of categories of carbonaceous materials which include nonagglomerating coals or lignites or sub-bituminous materials, tests embodying the teachings of Case have shown that unless the material within these categories is of the agglomerating type, it will not form a char bond and the resulting product is not comparable to that which is produced in accordance with the present invention.

Case, it will be noted, in describing his invention described an amount of carbon to be used in the following language:

> "By 'conglomerated body' herein is meant a coherent mass containing an intimate mixture of ore and reducing agent so proportioned to one another that the self-sufficient condition is attained: Such terms being employed herein to define the mass in its heat-treated form referred to as a 'char-bonded pellet' or 'char-bonded materials'."

The term "self-sufficient" refers to "self-reducing" as defining a chemical ratio in the char-bonded pellets by which enough carbon is intimately mixed with the iron ore to reduce to metallic form the iron oxide contained in the char-bonded pellets under the conditions of reduction in the smelting furnace.

The present invention is distinguished from the Case patent in these important respects: First, in the present invention a nonagglomerating carbonaceous material is utilized in forming the pellets. As indicated above, tests have shown that only agglomerating materials have the capability of forming a char bond. Secondly, the amount of carbon utilized in the present process is from 40 – 80% of the amount of carbon required (1) to carburize the iron produced in the present process and (2) to reduce all of the iron oxide constituents to the metallic state. Although these sub-self-sufficient amounts are overlapped by amounts taught by Case in specific examples, those specific examples do not achieve the desired result according to Case of providing a self-reducing pellet and there is no indication as to whether the coal used in the tests was of the agglomerating (bituminous) or nonagglomerating type. Third, the prior art produces a char bond of "graphitic material". In the present case, there is no tendency to produce a char bond and the amount of carbon in the pellet is limited so as not to interfere with the formation of a metallic bond and/or a ceramic bond within the pellet. There is no suggestion in Case that by limiting the amount of coal in the pellet, a bond other than char bond can be produced under sintering conditions, to produce a strong "durable" pellet. Moreover, there is no suggestion that the carbon deficiency can be supplied as external coal as hereinafter explained to produce a composite smelter charge composition.

With respect to U.S. Pat. No. 2,805,141 to Apuli, the present invention is clearly distinguished therefrom with respect to the relative amounts of carbon employed. Apuli is concerned with the production of iron oxide pellets, not a smelter charge. Thus there is an improper carbon:oxygen ratio. As will appear hereinafter, a carbon content of about 3.6% by weight of the pellet will give a carbon to oxygen ratio of about 0.11. In the present invention the carbon to oxygen ratio is approximately 0.8 or higher. Secondly, in the production of iron ore pellets, the pellets are produced under oxidizing conditions. In the present invention, reducing conditions are maintained. It will be observed that Apuli calls for oxidizing gases in the burning zone.

The patent to Kunii utilizes the combination of a traveling grate in which to produce pellets and a rotary kiln which in reality replaces a blast furnace. Coal is introduced separately into the rotary kiln. Coal is mixed with the hot pellets from the traveling grate to prereduce the iron oxide in the hot pellets. Coke which is produced in accordance with the process may be recycled. The patentee's process is distinguished from the traveling grate process and the rotary hearth process in that the former has the disadvantage that the material of the grate makes it very difficult to maintain the grate at a high reducing temperature over a prolonged period of time and thus renders the process unsuitable for providing highly metallized pellets. The latter poses a problem in that it cannot be used for effecting reduction of pellets.

The patent to Collin is concerned with a reduction process utilizing an electric arc furnace. He first produces pellets which contain substantially no metallic iron. In the present invention, at least about 30% iron is produced in the pellets. Quite importantly, however, Collin adds coke to the pellets at the time of introduction into the furnace. In the present invention, coke is produced simultaneously with the hardened prereduced pellets, and the material which is discharged from the traveling grate is a metallurgically complete blended smelter furnace charge.

The patentee Heitmann et al is concerned with the production of low density pellets which, after prereduction, are crushed and briquetted to provide a portion of a smelter furnace charge.

In the Sloughfy et al patent, slag is used in excess to coat the pellets and prevent reoxidation of prereduced iron on weathering. This composition is then fired in a rotary kiln with added coke. As indicated, the present invention contemplates the production of a metallurgically self-sufficient charge from a traveling grate machine suitable for direct introduction into a smelting furnace without further compositional adjustment. The patentee Schei contemplates increasing the yield of metal by molding the pellets or briquettes in a manner to provide a core which contains an excess of metal oxide surrounded by a second layer or pile which contains an excess of carbonaceous reducing agent. Both the core and the shell contain iron ore. All of the fuel is therefore within the pellet and none is external.

It is believed that in those cases where a full measure of carbon is utilized in the formation of a pellet and the carbon is of the nonagglomerating type such as may be used in accordance with the Ban patents above referred to, the presence of the relatively large amount of carbon interferes with the establishment of an internal matrix of metal and/or an internal matrix of ceramic material which will hold the pellet together.

The importance of holding the pellet together when using a low grade type carbonaceous material such as the lignites or sub-bituminous coals or extremely high grade coal such as anthracite coal (all of which materials are nonagglomerating) is that when these materials are used in accordance with the Case teachings, there results a very loosely bonded material which will crumble under pressure of the fingers. However, when pellets formed from the same materials and heated under the same conditions are made using a deficiency of a nonagglomerating carbonaceous material, the resulting pellets are extremely strong and can be handled without crumbling into fines. Thus, materials moving on grates or being dumped into a smelting furnace shaft maintain their integrity and do not crumble into fines which fall through grates on the traveling grate machine or contaminate and render inefficient the smelting furnace.

The invention is further distinguished from the prior art in that it provides a charge for a smelting furnace as distinct from merely pellets. Because a deficiency of carbon is used in forming the pellet moiety, the charge to the smelting furnace is nevertheless made self-sufficient by the addition of loose non-agglomerating carbonaceous material in the interstices between pellets or as a coating around the pellets. Also, the charge may desirably contain a fluxing material such as limestone or dolomite. The fluxing material may be present either in the pellet composition or in the interstitial composition or in both. Nevertheless, the resulting product for charging to the smelting furnace is formed from cheap raw materials and after sintering has excellent handling properties.

As indicated in much of the prior art referred to above, a problem has been encountered in the treating of pellets on a traveling grate with reoxidation. In accordance with the present invention, a reducing environment is maintained in the bed during the metallizing procedure. The formation of a pyrolytic char or coke as a reductant for electrothermal processing simultaneously is a distinct advantage and difference over the prior art. When the burden discharged from the traveling grate is cascaded into a supply hopper for introduction into an electrothermal smelting furnace, the char continues to provide a protective reducing environment so that the pellets in the smelter charge composition do not undergo reoxidation. A still further advantage of the present invention is that it enables the operator to provide corrective carbon much more rapidly than heretofore possible. When a deficiency of carbon is detected in the final product of the electrolytic smelting furnace, additional "corrective coal" can be introduced immediately into the process. The entire processing in accordance with the present invention enables the production of a hot metallurgical self-sufficient coke/hardened prereduced pellet composition available for immediate introduction into an electric arc smelting furnace.

BRIEF STATEMENT OF THE INVENTION

Briefly stated, therefore, the present invention is in a process for the preparation of a smelter furnace charge composition including prereduced metal and ceramic bonded pellets comprising the step of prereducing on a traveling grate green moist pellets of iron ore, water, and a nonagglomerating carbonaceous material with or without added flux material, the nonagglomerating carbonaceous material supplying an amount of fixed carbon which is (1) insufficient to reduce 100% of the iron to metallic iron and (2) to carburize the iron so formed and which amount is in the range of from 40 – 80% of that required to (1) carburize the iron and (2) reduce all of the iron oxide constituents to the metallic state.

External or interstitial carbonaceous material in an amount sufficient to supply the balance of the required amount of fixed carbon to meet the above stated conditions is also included in the charge composition. As indicated, the charge composition may also include a flux material either in the interstitial carbon moiety, or in the pellets, or distributed between both. The flux material within a pellet aids in the formation of ceramic bonds.

The charge is sintered or prereduced following conventional practice at a temperature of at least about 1800°F up to incipient fusion for a period of time to prereduce to the extent of removing at least about 50% of the oxygen from the iron oxides. It is not necessary that complete reduction of the iron values be achieved in the course of sintering although a close approach to 80% prereduction in the pellets is desired.

DETAILED DESCRIPTION OF THE INVENTION

Figure 1:
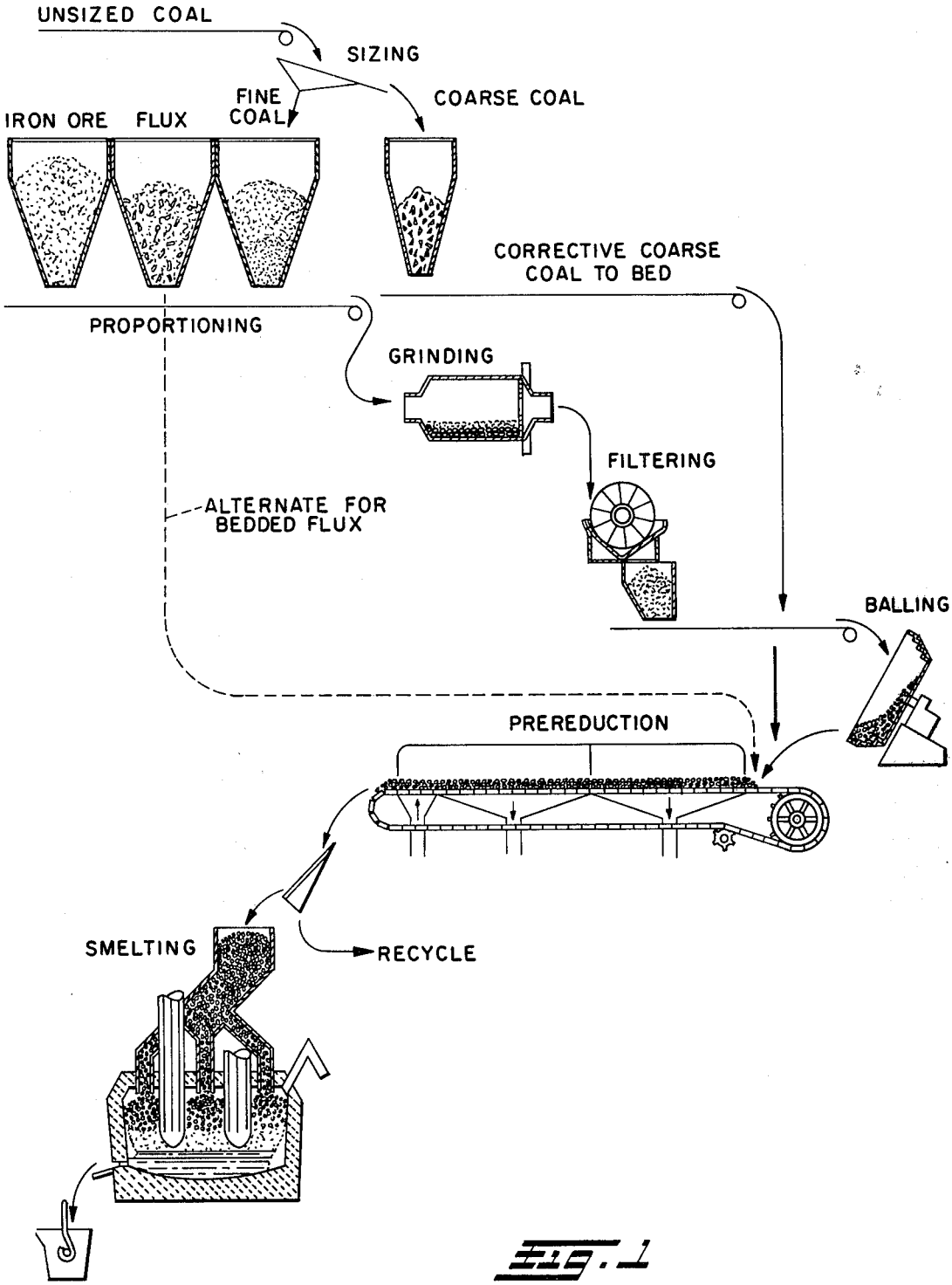
FIG. 1 is a diagrammatic and schematic illustration showing one embodiment of the present invention.
Figure 2:
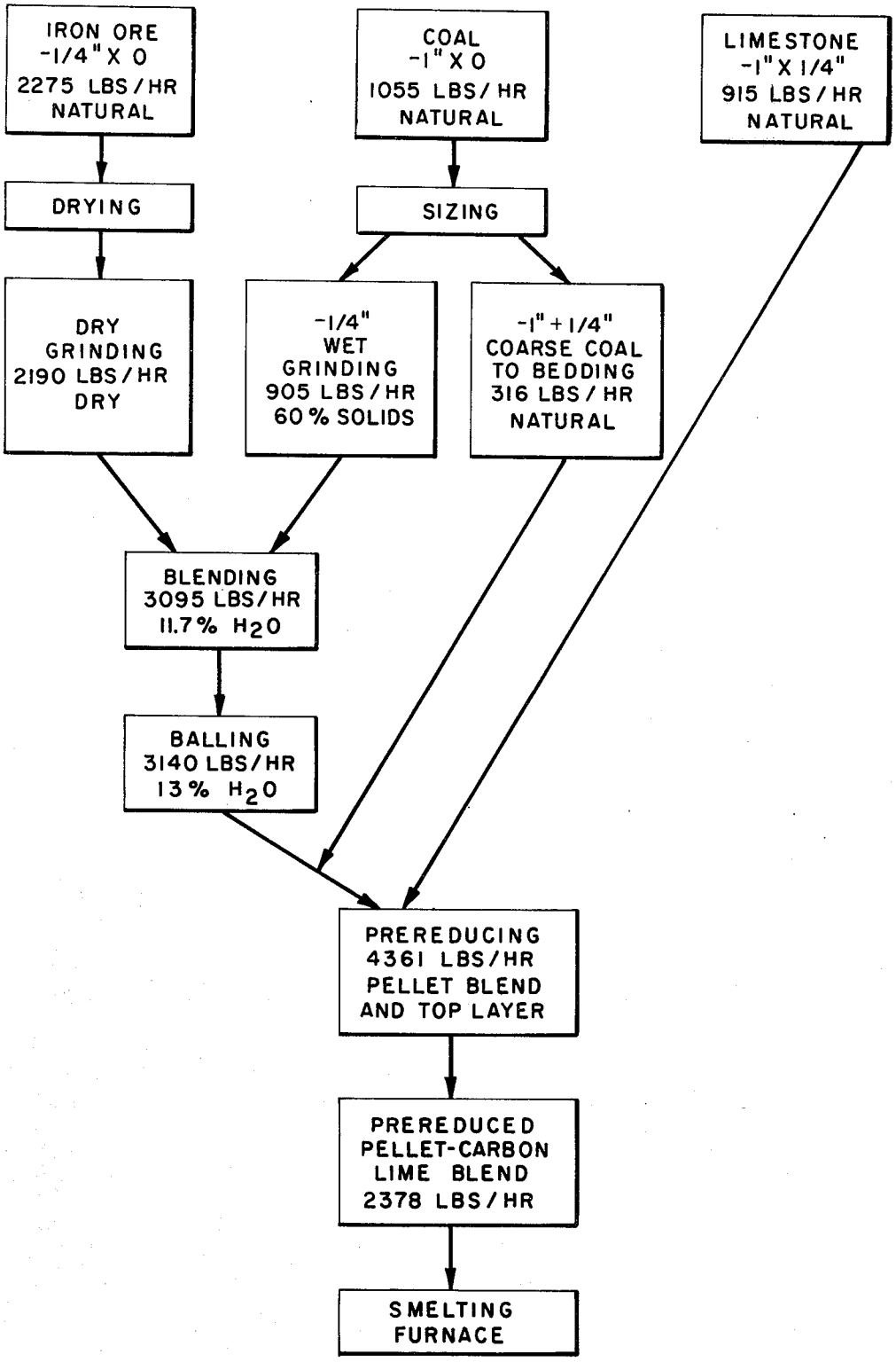
FIG. 2 is a material balance illustrating a specific example of the materials and the relative proportions thereof for producing a smelting charge composition for introduction into a smelting furnace.

Agglomerating coals or those which are characterized by caking and are used in making coke when used as reducing agents in iron ore pellets become partially consumed and the remaining part becomes pyrolytically converted and char-bonded within the pellet which may also be partially bonded by metallic and ceramic bonds. Through use of selected coking coals, e.g. bituminous coals, with strong agglomerating properties, composite pellets are converted to carbonized pellets which are extensively bonded by pyrolytic carbon, graphitic material, or char forms as matrices within the pellet. A wide variety of coals, however, do not have agglomerating properties as are characterized by fuels such as lignites, subbituminous coals, oxidized bituminous coals, anthracites, and miscellaneous forms of pyrolyzed carbon such as coke breeze, chars, etc. These materials are all nonagglomerating. (See "The Making Shaping and Treating of Steel", United States Steel Co., 6th Edition, 1951, Table 24, p. 159.) They cannot form carbonized or carbon bonded pellets. According to the present invention, techniques have been developed to make durable or hard prereduced pellets in a smelter charge composition with these nonagglomerating coals but wherein the bonding within the pellet is largely metallic and/or ceramic.

When using nonagglomerating forms of coal and carbon as a constituent of a composite pellet charge, the proportion of the carbonaceous ingredient in the mixture has been found to be critical for the production of durable products. It has been discovered that use of a quantity of nonagglomerating carbon in excess of that required for durable bonding as produced herein causes considerable weakening of the structure. Surplus nonagglomerating carbon in this context interferes with ceramic and metallic bond formation through what are believed to be "miniature parting planes" between potential bonding surfaces. Thus, whereas adjacent particles of reduced metallic iron would otherwise weld together under sintering conditions to form a metallic bonding matrix, the interposition of graphitic carbon, a well-known parting material, interferes with the formation of this strong matrix. Where the amount of fixed carbon is, however, sufficient or in excess, a carbon matrix is preferentially formed. If the carbon from which the carbon matrix is formed is of the agglomerating type, a strong char bond carbon matrix is formed. If the fixed carbon is of the nonagglomerating type, a weak carbon matrix crushable under finger pressure is formed.

For the production of a satisfactory quality of metallurgical burden as prereduced charge for a smelting furnace, it is important to maintain a defined and predetermined carbon to reducable oxygen ratio in the smelter charge composition. Use of a lower than requisite carbon-to-oxygen ratio causes insufficient reduction of the iron oxides to metallic iron, loss of metallic iron into the slag and production of relatively high melting metals which follow furnace operations. Carbon-to-oxygen ratios which exceed the requisite portions cause surplus carbon build-up within the furnace and wasteful use of the fuel. For this reason, a predetermined carbon-to-oxygen ratio should be maintained in a smelting furnace charge as well as a predetermined base-to-acid ratio to form a proper quality of slag, the latter in accordance with known procedures.

Certain problems have been noted when determining a proper metallurgical carbon-to-oxygen ratio of prereduced smelter charge composition formed with noncoking and noncaking or nonagglomerating coals. It has been determined that the pellets have relatively low strength properties due to the detrimental effect of high quantities of residual carbon which interfere with pellet bonding. For instance, an adequate but relatively low strength metallurgical burden of prereduced composite pellets may be made from lean iron ore and nonagglomerating coal and prereduced to a composite pellet with a carbon-to-oxygen ratio of 0.84. Such prereduced pellets are self-reducing and have the following general composition:

| | |
|---|---|
| $Fe_2O_3$ | 3.0% |
| FeO | 36.6% |
| $Fe_{met}$ | 23.0% |
| $SiO_2$ | 21.5% |
| $Al_2O_3$ | 8.3% |
| C | 7.6% |

Because of the relatively high quantities of carbon within such a pellet, interference with proper metallic and ceramic bonds is apparent and the crushing load of such pellets in the coal state is only on the order of 10 – 20 lbs., indicating a relatively weakly bonded structure. However, through the use of only 40% – 80% of the requisite nonagglomerating coal, the strength of the pellet has been improved from 3 – 7 times and thus has crushing loads on the order of 40 – 150 lbs. Crushing load or strength as used herein is the average load in pounds required to fracture a one-half inch pellet. Such pellets have a carbon-to-oxygen ratio of 0.64 in the fired pellet and illustrate marked increased bonding noted when the composite pellets are deficient in carbon. Such composite pellets are depleted of carbon and are deficient with respect to the carbon:oxygen ratio for a proper smelting charge. The term "requisite coal" means that quantity of coal, the fixed carbon of which is sufficient to reduce all the iron oxide constituents of the iron ore to the metallic state and to carburize the iron to an extent of from 1% to 3% by weight of the iron. The range of fixed carbon:oxygen ratios in the fired pellet moiety is quite limited and, although somewhat dependent upon the nature of the nonagglomerating coal, the ore and the presence or absence of flux, will lie within the range of from 0.2 to 0.7.

Table I summarizes the effects noted above.

TABLE I

Sintered[1] Pellets of Iron Oxide Ore and Various Coals Showing Effect on Crushing Strength

| Example | Kind of Coal | $CiO_2$ Ratio | % Requisite Coal | Gas | Bond | Strength lbs. |
|---|---|---|---|---|---|---|
| 1 | Agglomerating | 0.84 | 100% | Air | Char | 40–60 |
| 2 | Nonagglomerating | 0.84 | 100% | Air | Carbon | 10–20 |
| 3 | Nonagglomerating | 0.64 | 60% | Air | Metal | 40–150 |

[1]All at 1800 – 2400°F for 16 – 24 minutes

Any deficiency in the pellet moiety of carbon-to-oxygen ratio for a proper smelting charge is made up in accordance with the present invention from external carbon additions. These carbon additions may be made to the pellet bed as coarse structured agglomerating or nonagglomerating carbonaceous material since the nature of the coal in the external additions will not affect the blending within the pellets. The carbon additions may be supplied externally as rerolled material on the pellet surface with suitable binding agents. Finally, carbon additions may be made by using coarse carbon supplying materials as a nucleus material within the pellet core. The first, namely coarse addition externally to the pellet bed, is preferred. This addition is made prior to firing on a traveling grate machine. This carbonaceous material can be applied as a corrective metallurgical material, that is in higher or lower amounts as may be directed by the smelting operations.

Referring now to FIG. 1, there is here shown as a pictorial diagram the equipment and general flow sheet for dividing the amount of a nonagglomerating coal between the pellet and bed matrix. As indicated in the flow sheet representing a preferred embodiment of my invention, the flux or limestone can be added as either a constituent of the pellet or as a top layer on the bed of the pellet charge. Thus, iron ore, flux material, fine coal, and coarse coal of the same nonagglomerating type are maintained in supply hoppers. Through the use of proportioning means known to those skilled in the art, the proper proportions of the respective ingredients are deposited upon a conveyor and into a grinding and blending apparatus. Wet grinding may be used. The excess water is filtered out, and the resulting moist cake material conducted to a typical balling apparatus, an example of which is fully shown and described in U.S. Pat. No. 2,947,026 which illustrates a preferred form of pelletizing apparatus useful in forming pellets in accordance herewith.

The pellets containing from 8 – 15% moisture are cascaded onto a conventional straight line or circular traveling grate machine, a particularly useful embodiment of which is shown and described in U.S. Pat. No. 3,302,936. As indicated, flux material may be added as an overburden for the pellets. Also, corrective (in the metallurgical sense) coarse coal is directed by separate means to the traveling grate bed along with the green moist pellets. While the corrective coarse coal and the limestone flux may, if desired, be mixed with the pellets to form a more even pellet/external coal distribution, this is not necessary. The external additions of coal with or without added flux material are referred to herein as interstitial moieties to distinguish them from the pellet moiety.

The charge is then submitted to a sintering operation under conditions as more specifically set forth hereinafter to effect carbonization and prereduction of the iron ore at least in part to metal and in an amount sufficient with ceramic bonding to form durable hard pellets. The material exiting from the traveling grate machine may be stored and spontaneously cooled or, more desirably, discharged directly to a smelting furnace such as an electric arc smelter where the heat of the charge material is conserved and utilized in the smelting operation.

TABLE II

RAW MATERIALS FOR CONVERSION INTO DURABLE COMPOSITE SMELTER CHARGE

| Lean Iron Ore −¼"×0 | | Noncaking Coal −1"×0 | | Sized Limestone −1"×¼" | |
|---|---|---|---|---|---|
| $Fe_2O_3$ | 61.2 | FC | 34.4 | $CaCo_3$ | 95.0 |
| $SiO_2$ | 15.1 | VM | 29.0 | $SiO_2$ | 2.0 |
| $Al_2O_3$ | 5.7 | Ash | 10.1 | $H_2O$ | 3.0 |
| $H_2O$ | 10.0 | $H_2O$ | 26.5 | | |
| LOI | 8.0 | | | | |
| | 100.0 | | 100.0 | | 100.0 |

In Table II there has been shown a typical analysis of the three principal ingredients of the raw smelter charge composition. An analysis of a typical lean iron ore such as Paint Rock type ore having a particle size range such that all material passes through a ¼-inch mesh screen is given in Table I. Such material has a loss on ignition (LOI) of 8%. A nonagglomerating coal having a particle size such that all material passes through a one-inch screen has a fixed carbon content of 34.4%, contains 29% volatile material and has an ash content of 10.1%. The balance is water. A limestone flux material sized so that all passes through one-inch screen but is retained on a ¼-inch screen is 95% calcium carbonate, 2% silicon dioxide, and balance water. These ingredients are blended so that the final sintered carbon-to-oxygen ratio will be approximately 0.64.

TABLE III

CONDITIONS OF OPERATION FOR CONVERTING GREEN COMPOSITE PELLET - COAL - LIMESTONE BED INTO DURABLE SMELTER CHARGE

| | | |
|---|---|---|
| Machine System | 1½ + 15½' | |
| Charge Rate | | lbs/hr |
| Green composite pellets | −½" + ¼" 13.0% $H_2O$ | 3140 |
| Coarse coal | −3" + ¼" 26.5% $H_2O$ | 316 |
| Blend | −1" + ¼" | 3456 - 8" layer |
| Top layer | −1" + ¼" 3.0% $H_2O$ | 915 - 2" layer |
| Drying Zone | | |
| Time | 8–12 minutes | |
| Temperature | 450–750°F | |
| Draft rate | 200–350 SCFM/Ft² | |
| Prereduction Zone | | |
| Time | (downdraft) | 16–24 minutes |
| Temperature | (downdraft) | 1800–2400°F |
| Draft rate | (downdraft) | 80–180 SCFM/Ft² |
| Time | (updraft) | 4–6 minutes |
| Temperature | (updraft) | Ambient |
| Draft rate | (updraft) | 30–60 SCFM/Ft² |

Referring now to Table III, a typical traveling grate machine is a straight line machine 1.5 feet wide by 15.5 feet long. The green composite pellets discharged from the balling machine contain 13% water and are approximately ½ inch in diameter, all passing through a ½-inch screen and being retained on a ¼-inch screen. 3140 pounds per hour of the composite pellets are charged to the traveling grate. Coarse coal containing 26.5% of water, all passing a one-inch screen and being retained on a ¼-inch screen is added to the burden at the rate of 316 lbs. per hour. The blend totaling 3456 lbs. per hour is applied as an 8-inch layer on the traveling grate machine. A top layer of limestone on passing a one-inch screen and being retained on a ¼-inch screen and containing 3% water is charged at the rate of 915 lbs. per hour as a 2-inch overburden layer.

The composite unsintered burden enters first a drying zone where it is in residence for a period of from 8 – 12 minutes and is exposed to recycle gas at a temperature of from 450° to 750°F as a downdraft at the rate of 200 to 250 standard cubic feet per minute per square foot of grate area (SCFM/Ft²). The moisture content is slowly reduced in this zone to prevent destruction of the pellets by the formation of steam within the pellet due to too rapid heating. The pellets leave the drying zone at a temperature of about 700°F and enter a prereduction zone. The residence time in the prereduction zone is from 16 – 24 minutes. Oxidizing or neutral gas, e.g. air, is passed downwardly through the burden to raise the temperature of the pellets to from 1800°F to the point of incipient fusion, i.e. just below the melting point of the charge. This temperature approximates about 2300° to 2400°F. The gas is passed through the burden at a rate of from 80 – 180 SCFM/Ft². Thereafter, the burden may desirably enter an updraft zone or "kiss" for a residence time of from 4 – 6 minutes using ambient air forced through the burden at the rate of from 30 – 60 SCFM/Ft$^2$ to prevent overheating and thus undue wear of the grates in the traveling grate machine. The terminal "cooling" gas may then be recycled to the drying zone to conserve heat.

Figure 3:
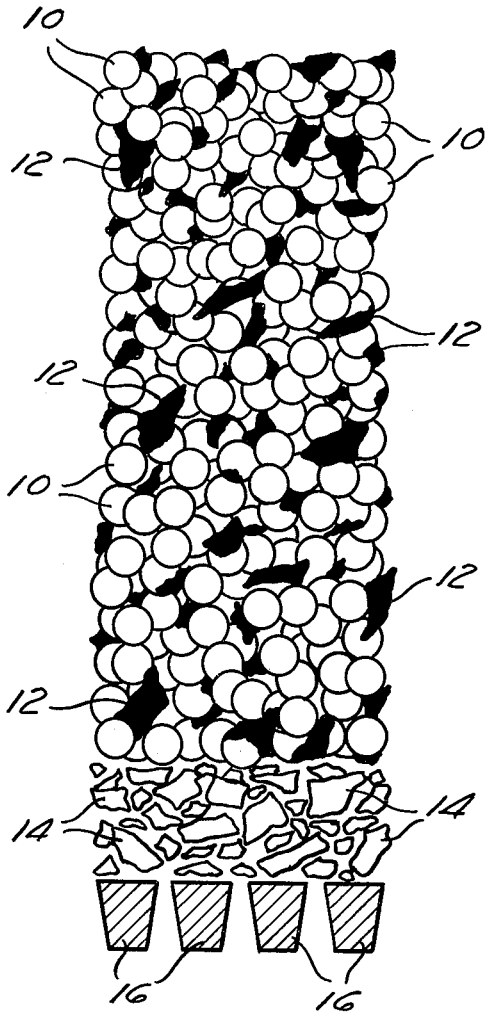
FIG. 3 is a diagrammatic representation of a section through the burden on the traveling grate in accordance with the present invention.

Referring to FIG. 3 of the drawings, there is here shown a cross section through the burden in accordance with the present invention. The vertical particles represent iron ore pellets and are identified by the numeral 10. Interspersed among the pellets are particles of nonagglomerating carbonaceous material 12. Underlying the burden is a hearth layer preferably formed of particles 14 of a fluxing material, e.g. limestone, to protect the grates from prolonged exposure to excessive heat. Grate bars 16 are typical grate bars of the pallets on a traveling grate machine, e.g. a Dwight-Lloyd traveling grate machine.

In the burden composed of pelletized particles 10 and the interspersed external noncoking carbonaceous material 12, the coal is ignited and burned in the presence of air to provide heat for the various reactions which occur. Other coal in the presence of the heat yields fixed carbon or coke plus volatile matter. Iron carbonate within the ore in the presence of heat yields $Fe_3O_4$ plus carbon monoxide plus carbon dioxide. Hydrated $Fe_2O_3$ plus heat gives up its moisture. These are calcination reactions. The reduction which occurs within the burden is the reaction of carbon with iron carbonate, ferric oxide, and ferrous oxide. The products are metallic iron, iron oxide (FeO), carbon monoxide and carbon dioxide. These reactions are well understood in the prior art. In the meantime, the hearth layer composed of flux material in the presence of heat gives up carbon dioxide and yields calcium oxide and magnesium oxide.

The manner of handling the charge burden on the traveling grate and the conditions observed therein are typical of those observed for sintering operations. Details of operating conditions are fully set forth in the aforesaid patents to Ban which to the extent of the disclosure of operating conditions and equipment are incorporated herein by reference thereto. With the exception of the substitution of nonagglomerating carbonaceous materials for the normally used coking or agglomerating coals and observing the decreased amount of carbon so as to be within the range of from 40 – 80% of the requisite amount of fixed carbon, the formulations of the sinter burdens are otherwise well known. Rich or lean iron ores may be used. The amount of nonagglomerating coal is predetermined in relation to the iron values of the ore being used and the fluxing materials and other additive materials are used in metallurgical amounts, all in accordance with known procedures.

The foregoing process results, therefore, in a durable or readily handleable sinter product adapted for discharge directly to a smelting furnace. The advantages of the present process include the utilization of inexpensive sources of carbon in a carbon deficient pellet with the balance of the carbon requirement being supplied externally to produce a metallic or ceramic bonded material useful as a smelter charge composition.

What is claimed is:

1. A process for the preparation of a complete self-reducing charge composition including prereduced metal pellets having a crushing strength of from about 40 to about 150 pounds comprising the step of prereducing on a traveling grate:

a. green pellets comprising iron oxide, water, and a nonagglomerating carbonaceous material without any additional binder for binding the pellet during and after prereduction said nonagglomerating carbonaceous material supplying an amount of fixed carbon which is insufficient to reduce 100% of the iron oxide to metallic iron and is in the range of from 40% to 80% of that required to:
   1. carburize the iron so produced; and
   2. reduce all the iron oxide constituents to the metallic state;

b. external corrective coarse carbonaceous material in an amount sufficient to supply the balance of the required amount of fixed carbon to:
   1. carburize the iron so produced; and
   2. reduce all the iron oxide constituents to the metallic state, said prereducing being at a temperature of at least 1800° F to reduce at least a portion of the iron oxide to metallic iron, and said external carbonaceous material being physically blended with said green pellets.

2. A process in accordance with claim 1 which is further characterized by the inclusion in the composition to be prereduced of a flux material.

3. A process for the preparation of a smelter furnace charge composition including prereduced metal pellets having a crushing strength in excess of 40 lbs. comprising the steps of:

a. forming green moist pellets consisting essentially of granular iron oxide, water, and nonagglomerating carbonaceous material, said nonagglomerating carbonaceous material supplying an amount of fixed carbon which is insufficient to reduce 100% of the iron oxide to metallic iron and sufficient to provide a ratio to the reactable oxygen of from 0.2 to 0.7 in the fixed pellet;

b. adding external carbonaceous material to said pellets as a burden to a traveling grate, said external carbonaceous material being in an amount sufficient to supply the balance of fixed carbon to:
   1. reduce all the iron oxide constituents to metallic iron;
   2. carburize the metallic iron; and c. sintering the charge at a temperature of from 1800° to 2400° F for a period of time to prereduce and remove at least 50% of the oxygen from the iron oxide.

4. A process in accordance with claim 3 which is further characterized by the inclusion of a flux material.

5. A process for the preparation of a smelter furnace charge composition including prereduced metal pellets having a crushing strength in excess of 40 lbs. comprising the steps of:

a. forming green moist pellets consisting essentially of granular iron oxide, water, nonagglomerating carbonaceous material, and flux material, said nonagglomerating carbonaceous material supplying an amount of fixed carbon which is insufficient to reduce 100% of the iron oxide to metallic iron and sufficient to provide a ratio to the reactable oxygen of from 0.2 to 0.7 in the fixed pellet;

b. adding external carbonaceous material to said pellets as a burden to a traveling grate, said external carbonaceous material being in an amount sufficient to supply the balance of fixed carbon to:

1. reduce all the iron oxide constituents to metallic iron;
2. carburize the metallic iron; and c. sintering the charge at a temperature of from 1800° to 2400° F for a period of time to prereduce and remove at least 50% of the oxygen from the iron oxide.

* * * * *

UNITED STATES PATENT AND TRADEMARK OFFICE

CERTIFICATE OF CORRECTION

PATENT NO. : 3,938,987

DATED : February 17, 1976

INVENTOR(S) : Thomas E. Ban

It is certified that error appears in the above-identified patent and that said Letters Patent are hereby corrected as shown below:

Column 8, Table III, fifth line:

"Machine System $1\frac{1}{2}$ + $15\frac{1}{2}$' " should read

-- Machine System $1\frac{1}{2}$' + $15\frac{1}{2}$' --.

Column 8, Table III, ninth line:

"Coarse coal —3" + $\frac{3}{4}$" 26.5% $H_2O$ 316" should read

--Coarse coal —1" + $\frac{3}{4}$" 26.5% $H_2O$ 316--

Signed and Sealed this

*eighth* Day of *June 1976*

[SEAL]

*Attest:*

RUTH C. MASON
*Attesting Officer*

C. MARSHALL DANN
*Commissioner of Patents and Trademarks*